United States Patent [19]

Siebens

[11] 4,203,641

[45] May 20, 1980

[54] DOUBLE BUSHING INSERT

[75] Inventor: Larry N. Siebens, Great Meadows, N.J.

[73] Assignee: Amerace Corporation, New York, N.Y.

[21] Appl. No.: 970,314

[22] Filed: Dec. 18, 1978

[51] Int. Cl.[2] ..... H01R 13/54

[52] U.S. Cl. ..... 339/75 P; 174/152 R; 339/143 C

[58] Field of Search ..... 339/111, 143 R, 143 C, 339/14 R, 14 L, 60 R, 252 R, 75 P, 92 R; 194/73 R, 156 R

[56] References Cited

U.S. PATENT DOCUMENTS

| | | | |
|---|---|---|---|
| 3,073,891 | 1/1963 | Barengoltz | 174/152 R X |
| 3,539,972 | 11/1970 | Ruete et al. | 339/111 |
| 3,662,297 | 5/1972 | Tachick et al. | 339/60 R |
| 3,909,509 | 9/1975 | Fisher | 174/152 R |
| 3,930,709 | 1/1976 | Stanger et al. | 339/143 R X |
| 4,050,149 | 9/1977 | Storck et al. | 339/252 R X |
| 4,059,329 | 11/1977 | Macemon | 339/60 R |

OTHER PUBLICATIONS

RTE Corporation Bulletin F 1152, "Installation Instructions," Section 719, p. 11, Waukesha, Wis., Jul. 18, 1977.

*Primary Examiner*—Roy Lake
*Assistant Examiner*—Eugene F. Desmond
*Attorney, Agent, or Firm*—Richard A. Craig; S. Michael Bender; Ken Richardson

[57] ABSTRACT

An electrical connector in the form of a double bushing insert comprises means for electrically and mechanically threadably connecting the insert to a transformer bushing well. Such means is adapted to permit free angular rotation of the insert in opposite directions through a predetermined angle after the insert has been torqued into fixed operative threadable engagement with the bushing well stud without a need to back-off the insert from the stud by loosening the threaded connection therebetween.

15 Claims, 5 Drawing Figures

132
134
146
148
150
152
142
144
140
154
2
24
26
10
18
22
162
82
12
164
136
138
158
156

DOUBLE BUSHING INSERT

The present invention relates generally to electrical connectors for electrical power distribution systems and pertains, more specifically, to an improved double bushing insert adapted to be threadably mated with a bushing well receptacle of an electrical transformer.

In recent years, in electrical distribution systems such as those used to provide electrical power to commercial and residential dwellings, it has been desirable to employ electrical double bushing inserts and intermating electrical elbow connectors to couple high-voltage power feeder cables to the input connections or terminals of a plurality of step-down electrical distribution transformers. The employment of such double bushing inserts, in particular, advantageously eliminates the conventional practice of using unprotected exposed electrical bus elements, connected between the transformer input connections and the primary windings within the transformer casings, as well as providing a more compact arrangement of the transformer installations and all of the associated connectors and cable connections therewith.

However, when the double bushing inserts are torqued into fixed operative threadable engagement with the transformer bushing well receptacle, surface regions associated with the twin legs of the double bushing are often not suitably aligned to interface with complementary surface regions of corresponding elbow connectors so as to facilitate a connection therebetween. This is so as each of the twin legs projecting outwardly from the bushing well may be orientated with respect to one another, such that, a first one of the legs, upon connection thereto of a first corresponding elbow connector and the associated cable attached thereto, may interfere with the connection of another elbow and its associated cable to the remaining second or other leg. This necessitates adjusting the position of the double bushing by unscrewing or loosening the double bushing at the threaded-stud of the transformer bushing well receptacle to which it is positively fastened until each one of the twin legs is rotated into proper alignment for its connection to the corresponding elbow connector. Accordingly, it is the prior art practice to rotate or turn-back the double bushing at the threaded-stud for up to about one-half of a full turn if necessary. Such a conventional method of adjusting the relative position of the double bushings with respect to the elbow connectors is tolerated for the purpose intended but it has numerous disadvantages.

For example, due to the high-currents being transferred between the transformer threaded-stud and the double bushing connected thereto, backing-off the double bushing from the threaded-stud increases the possibility of the electrical connection formed therebetween failing to meet accepted current transfer performance standards set by the National Electrical Manufacturers Association, as well as increasing the possibility of forming a weak or loose electrical connection therebetween. This, in turn, could cause a variety of additional failures such as arcing, overheating, melting or burning of the intermating threads associated with the threaded-stud and the double bushing. Such a loose connection could also constitute a hazard to linemen in the vicinity thereof, as well as cause destructive failure of either or both the transformer bushing well and the double bushing.

Accordingly, if the threads of the bushing-well stud were destroyed, new threads would have to be formed therefor. In the event the bushing well was more severely damaged, the entire bushing well would need to be replaced. When this happens, it becomes necessary to disconnect and remove the mounted transformer so that it can be taken to a shop where the damaged bushing well can be removed and a new one put in its place.

Against the foregoing background, it is a general object of the present invention to provide a means for adjusting the orientation of an operatively mounted transformer double bushing insert which overcomes the many shortcomings and disadvantages associated with the transformer mountings of prior art inserts.

It is another general object of the present invention to provide a means for a transformer double bushing insert which permits adjustment of the orientation of the insert when operatively mounted at the transformer without a requirement for special skills or tools.

It is yet another general object of the present invention to provide a low-cost simplified means for adjusting the orientation of an operatively mounted transformer double bushing insert comprising easy-to-manufacture components.

It is a more specific object of the present invention to provide a transformer double bushing insert including means which allows the insert to be freely rotated through a predetermined angle in opposite directions after the insert is torqued into fixed operative threadable engagement with the stud of the transformer's bushing well without need to loosen the threaded engagement therebetween so that surface portions associated with the twin legs of the insert can be brought into alignment with complementary surface portions of corresponding intermating electrical elbow connectors thereby allowing the twin legs to be electrically united with the elbow connectors regardless of the angular position at which they are operatively fixed after torquing for the purpose of achieving threaded engagement thereof.

The above objects, as well as further objects and advantages, are attained by the present invention which may be described briefly as comprising an electrical connector bushing insert adapted for electrically coupling high-voltage power cables to an electrical transformer and having means therein for electrically and mechanically threadably connecting the insert to the threaded stud of a transformer bushing well receptacle, and further including means to allow the insert to be freely rotated through a predetermined angle in opposite directions after the insert has been torqued into fixed operative threadable engagement therewith, such means obviating the need to turn back the insert at the bushing well or rotatively loosen the threaded engagement therebetween.

The invention will be more fully understood and further objects and advantages thereof will become more apparent from the following detailed description of a preferred embodiment of the invention illustrated in the accompanying drawing, in which.

Figure 1:
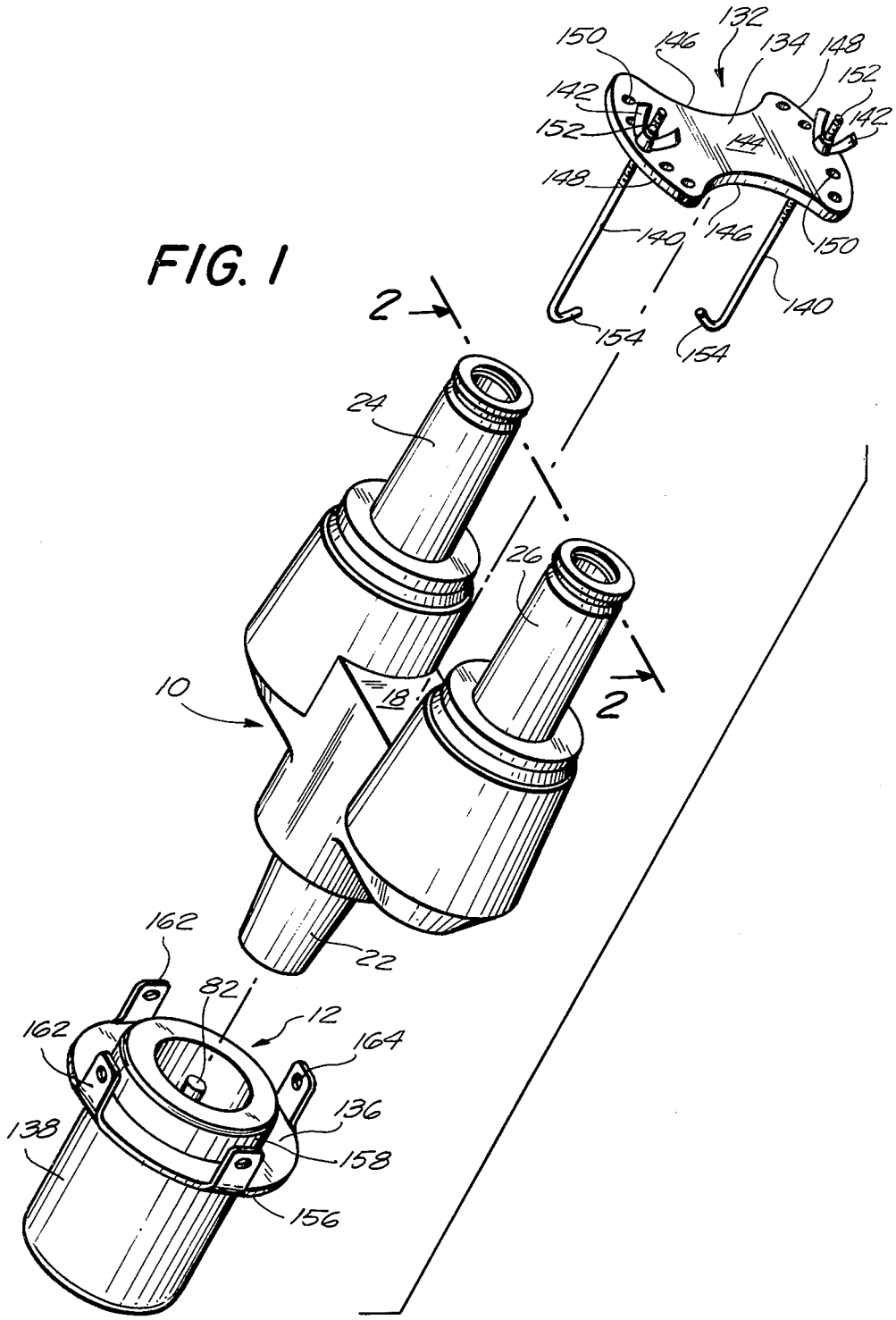
FIG. 1 is an exploded view in perspective, illustrating a double bushing insert assembly constructed in accordance with the invention and of a bushing well receptacle of an electrical distribution transformer.
Figure 2:
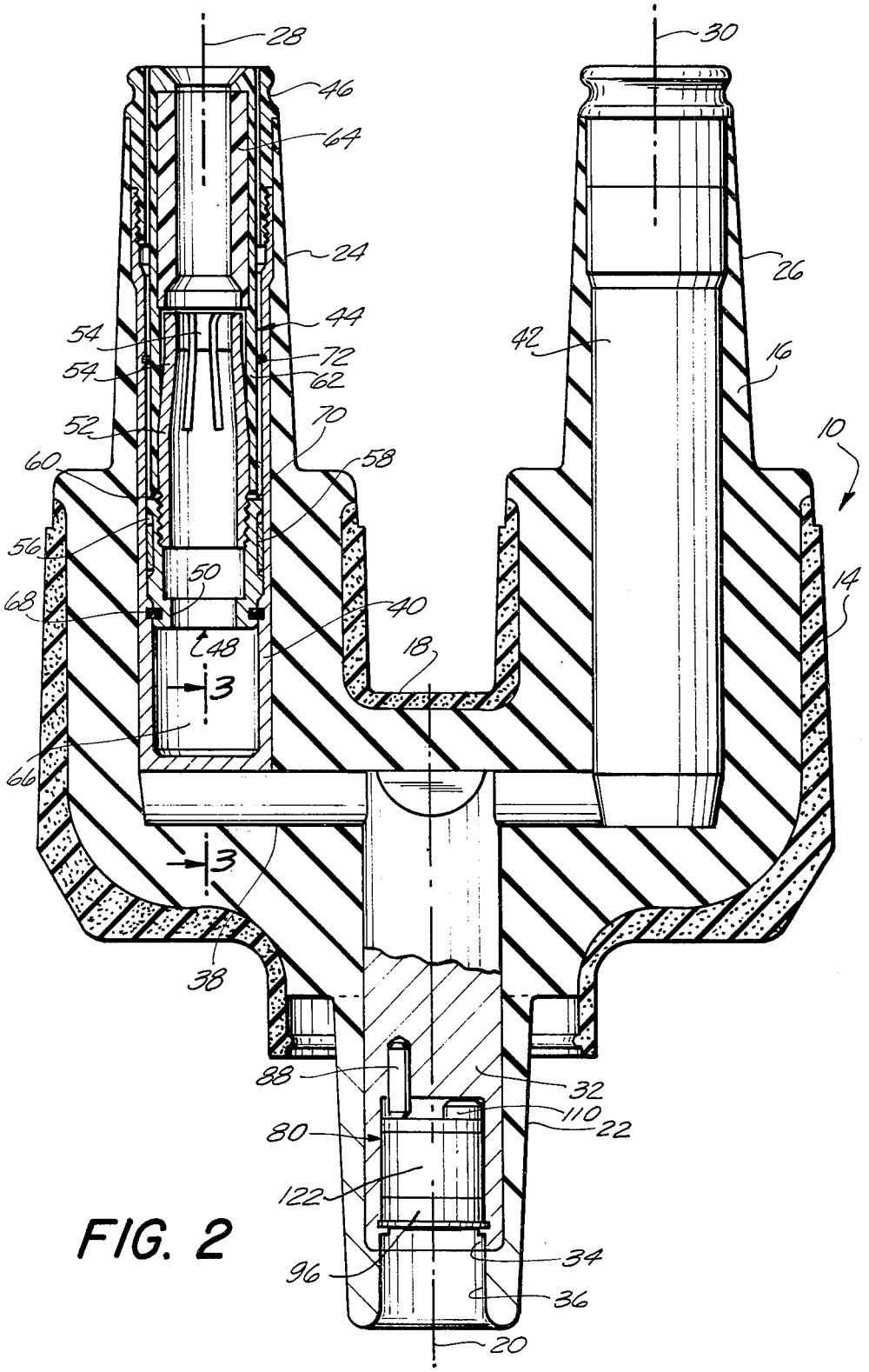
FIG. 2 is a side view, in section, of the double bushing insert component of the Assembly taken along line 2—2 of FIG. 1.
Figure 3:
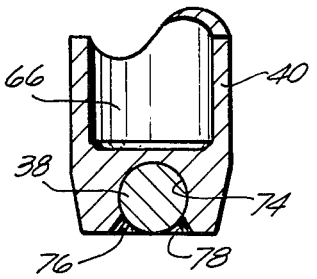
FIG. 3 is a fragmentary portion, in section, of the bushing insert taken along line 3—3 of FIG. 2.

Referring initially to FIGS. 1–3, there is schematically shown a preferred form of double bushing insert 10 for electrically coupling a pair of high-voltage, high-current, distribution or feeder cables to a bushing well receptacle 12 of an electrical transformer such as those typically used to distribute electrical power to commercial and residential dwellings. Since the details of construction of the cables and of the transformer are well-known in the art and form no part of the present invention, these components have been omitted from the drawing for the sake of clarity. Similarly, bushing well receptacle 12 is of a type well-known in the art as exemplified, for example, by the bushing well described in U.S. Pat. No. 3,539,972, assigned to the same assignee as the present application.

The preferred embodiment of the double bushing insert 10 comprises an outer sleeve or housing member 14 of semi-conductive elastomeric material molded to an inner sleeve or housing member 16 of an insulative elastomeric material as is well-known in the art. Insert 10 further comprises a central portion 18 having an imaginary central axis 20, and a first tubular frusto-conically tapered leg portion 22 coaxial to axis 20, but extending substantially downwardly from central portion 20 as viewed best in FIGS. 1 and 2. Insert 10 also comprises laterally spaced second and third frusto-conically tapered leg portions 24 and 26. Each one of the leg portions 24 and 26 has a corresponding imaginary central axis 28 and 30, laterally offset from center axis 20 but generally parallel to and coplanar therewith. Each leg portion 24 and 26 extends substantially upwardly from the central portion 18 extending between the leg portions 24, 26, thus giving insert 10 a bifurcated or fork-like configuration.

Disposed internally within downwardly depending leg portion 22, coaxial to axis 20, is a solid electrically conductive bar 32, preferably formed from metal such as aluminum. The bottommost end of bar 32 terminates in a spaced manner from the terminal end of leg portion 22 and has a cylindrical shaped recess 34 therein in communication with a substantially cylindrically shaped recess 36 in the bottommost end of leg 22. Bar 32 extends upwardly from leg portion 22 into the central portion 18 where at its upper end it is joined to a cylindrically shaped conductive cross-bar 38, the latter also preferably being of aluminum. The cross-bar 38 and the bar 32 are securely joined together in a suitable fashion as by welding or, if desired, may be formed as a one-piece or unitary part as by casting.

The opposed ends of the cross-bar 38 extend into the bottom portion of each lateral leg portion 24, 26 where they are respectively connected to identical metallic (e.g., aluminum) sleeve members 40, 42, each of which forms a conductive housing for a corresponding female connector assembly 44 adapted to receivably engage the contact member or probe of a cooperating complementary male "elbow" connector member when the housing of the latter is interfaced with the conically tapered external surface of each leg portion. Hence, it will be understood that the male contact member or probe is adapted to be receivably engaged within the hollow interior afforded by the female connector assembly 44 and each corresponding sleeve member 40, 42 as the case may be. Such interengaging male (elbow) and female connector assemblies are well-known from U.S. Pat. Nos. 3,539,972 (Ruete et al.) and 3,654,590 (Brown). And although the female connector assembly of either the U.S. Pat. No. 3,539,972 or the U.S. Pat. No. 3,654,590 may be employed in practicing the present invention, it is preferred that the improved female connector assembly fully described in copending U.S. application Ser. No. 937,737 of Frank M. Stepniak et al., filed Aug. 29, 1978, and assigned to the same assignee as the present application, be used instead. Accordingly, application Ser. No. 937,737 is hereby incorporated herein by this reference and made part of the present disclosure. Even so, the preferred female connector assembly 44 now will be briefly described, it being understood that since each of the two leg portions 24, 26 includes a similar female connector assembly, a description of only one will suffice for the other.

As shown in FIG. 2, with respect to the leg portion 24, the metallic sleeve 40 carries a plastic nose ring 46 threadedly connected thereto at the sleeve's upper, open end. The sleeve 40 and the nose ring 46 define the boundaries of an internal cylindrical volume in which is disposed the female connector assembly 44 which latter is adapted for slidable movement therein between first and second positions as will be explained in more elaboration below. The female connector assembly 44, in turn, comprises a cylindrical piston member 48 having a central aperture 50 and a hollow, cylindrical female contact member 52 threadedly affixed thereto. The female contact member 52 terminates at its upper end in a plurality of circumferentially spaced resilient contact fingers 54. The outer surface of the piston member 48 includes an annular recess 56 in which is seated a ring-shaped electrical contact element 58 of the well-known resilient louver type to establish a slidable connection between the piston member 48 which is conductive and the internal surface of the wall of metallic sleeve 40. A ring-washer 60 preferably is employed to define the depth of threaded engagement between female contact member 52 and piston member 48. Press-fit onto the outer diameter of the female contact member 52 substantially as shown is a cylindrical tube or sleeve 62 of insulative material such as glass filled nylon, which tube 62 extends to the terminating or upper end of the nose ring 46 when female connector assembly 44 is in the position depicted in FIG. 2. Affixed to the interior surface of tube 62 between the upper end of the nose ring 46 and the upper end of contact fingers 54, is a guide ring 64, of gas-evolving arc-quenching material as is well-known in the art.

By the foregoing arrangement, the male contact probe of a complementary connector is adapted to enter the guide ring 64 and engage the resilient contact fingers 54 of the female connector assembly 44 as the housing of the complementary connector is interfaced with or is seated onto the external surface of leg portion 24. If the circuit being connected by the complementary male and female connectors is energized, an arc will be struck between the male contact probe and the female contact member 52 before metal-to-metal contact therebetween is achieved and the arc will cause evolvement of gas from guide ring 64 which gas will cool the arc and quench same. If the male connector and the female contact member 52 are engaged or separated under normal loadmake and/or loadbreak conditions, an arc of moderate intensity will be struck and the evolved gas will flow through the hollow interior of the female contact member 52, the central recess 50 of piston member 48, and thence into the chamber 66 located at the bottom of the metallic sleeve 40. However, under such condition a C-ring 68 seated in an annular recess in the outer circumferential surface of the piston member 48 and in an opposed annular recess in the inner circumferential surface of the wall of the sleeve 48 will prevent slidable displacement of the piston member 48 from the position shown in FIG. 2.

On the other hand, should the male connector be engaged with the female contact member 52 under a condition where a fault such as a short circuit is in the line, an arc of relatively high intensity will be struck causing the pressure of evolved gas to rise very rapidly in the chamber 66. Consequently, when the gas pressure reaches a predetermined level this causes piston member 48 to overcome its latching engagement with C-ring 68 and the gas pressure acting against the bottom face of piston member 48 rapidly drives female connector assembly 44 upward until upwardly facing transverse surface 70 on piston member 48 engages a stop-ring 72 seated in an annular recess in the inner wall surface of sleeve 40. Such rapid upward movement of the female connector assembly 44 facilitates metal-to-metal contact between the femal contact member 52 and the contact probe of the complementary male connector in less time than would be the case in the absence of such gas-assisted piston displacement of assembly 44 thereby accelerating quenching of the arc and avoiding build-up of excessive gas pressure which latter might possibly lead to physical injury to the operator thereof.

As mentioned above, the second leg portion 26 of the double bushing insert 10 preferably comprises an identical female connector assembly, which functions in the same manner described above with regard to leg portion 24.

Each of the female connector assemblies in leg portions 24, 26 is electrically connected to the conductive bar 32 by means of metallic sleeves 40, 42 and the cross-bar 38 preferably in the manner shown in FIG. 3. Hence, with respect to leg portion 24, the end portion of the cross-bar 38 is seated in a complementary semi-cylindrical recess 74 formed in the solid bottom portion of sleeve 40 substantially as shown. The bar preferably is welded to the sleeve bottom portion as at 76 and 78 to effect a secure connection between these parts. The opposed other end of cross-bar 38 is connected to the bottom portion of sleeve 40 in leg portion 26 in the same manner. It is thus seen, that when the male contact probe of a complementary connector is engaged with the female contact member 52 of either leg portion 24, 26 an electrically conductive circuit will be established through the contact probe of the complementary male connector, the female contact member 52, the piston member 48, the annular contact 58, the sleeve 40 or 42, the cross-bar 38, and the conductive bar 32.

In accordance with the present invention there is provided a means generally indicated by reference numeral 80 for effecting a secure electrical and mechanical connection between the conductive bar 32 and the stud 82 of bushing well receptacle 12 which means 80 permits the double bushing 10 to be rotatably oriented in a desired position to facilitate connection thereto of a pair of complementary elbow (male) connectors. Such means 80 is located in the cylindrical recess 34 in the bottom portion of the conductive bar 32 which recess 34 and means 80 will now be described in further detail.

Figure 4:
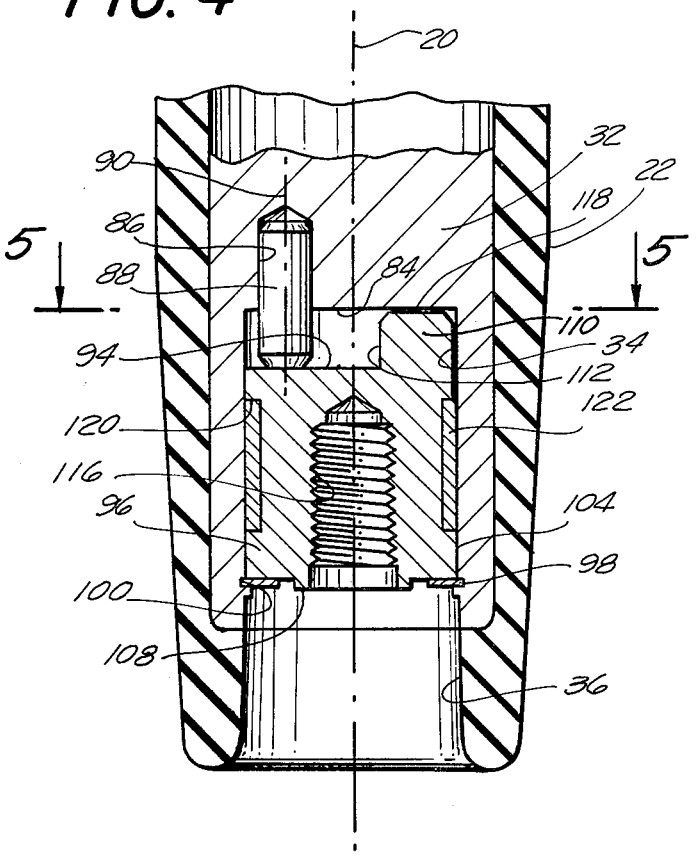
FIG. 4 is a fragmentary portion of the section of FIG. 2 showing in enlarged detail the bottommost portion of the double bushing insert according to the present invention.
Figure 5:
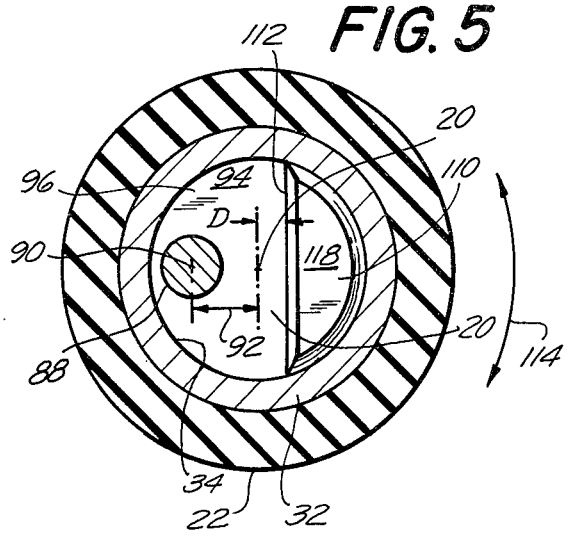
FIG. 5 is an end view, in section, of the double bushing insert taken along line 5—5 of FIG. 4.

Pursuant to the invention and referring to FIGS. 2, 4 and 5, a recess 34 in bar 32 terminates inwardly thereof in a generally planar circular shaped end wall 84. Disposed within the surface of end wall 84 is a cylindrically-shaped axially extending pin-receiving recess 86 in which is seated a cylindrical pin member 88 projecting axially beyond end wall 84 into recess 34 substantially as shown in FIG. 4. The recess 86 is positioned in a laterally offset manner relative to central axis 20 such that the imaginary axis 90 of pin member 88 is spaced from and parallel to the imaginary axis 20 by the radial distance indicated by arrow 92 (FIG. 5).

Pin member 88 is loosely seated within pin-receiving recess 86 so as to allow the projecting end portion thereof to rest upon the upwardly facing surface 94 of a cylindrical bushing 96 supported interiorly of recess 34 in the position shown in FIG. 4 by means of C-spring retainer 98 seated within an annular recess 100 in the wall surface of recess 34. The pin member is fabricated from a suitably strong material such as steel, for example, so that it is capable of resisting rotation of bushing 96 within recess 34 when in abutting engagement therewith as will be more fully explained below.

The bushing 96 disposed within recess 34 is in the form of an elongated cylindrical or tubular-shaped body fabricated from a strong, electrically conductive material preferably such as copper or aluminum material. Bushing 96 is characterized by an external circumferentially extending wall surface 104 and two opposed planar-shaped end surfaces 94 and 108. The outer diameter of the bushing 96 is slightly less than the inner diameter of recess 34 to facilitate the slidable insertion of the bushing into the recess and rotation thereof within the recess.

Bushing 96 includes a portion 110 extending axially toward the end wall 84 of recess 34 from end surface 94 but which terminates short of the end wall 84 so that the bushing is freely rotatable within recess 34. The axially extending portion 110 has the shape of a segment as viewed in FIG. 5 and thus defines a vertically oriented wall surface 112 whose opposed laterally outer portions are adapted respectively to abuttingly engage pin member 88 when bushing 96 is rotated within recess 34 relative to pin member 88 in opposite directions respectively as indicated by arrow 114. In the absence of pin member 88 bushing 96 would be capable of 360° rotation within recess 34. However, with pin member 88 being in the position shown, the bushing is capable of relative rotation in opposite directions within recess 34 through a predetermined rotation angle less than 360°. In the preferred embodiment, the size of segmental portion 110 substantially as shown relative to the size and location of the pin will produce a predetermined rotation angle of about 180° which is quite suitable for carrying out the present invention. Changes in the predetermined rotation angle may be achieved, if desired, by increasing or decreasing the distance "D" between the chord defining segment 110 and wall surface 112 on the one hand and the imaginary axis 20 of the recess 34 and bushing 96 on the other hand.

Opposed bushing end 108 includes an axially extending internally threaded hole 116 disposed therein centered axially about center line 20. The internally threaded hole 116 in the bushing 96 is adapted to facilitate threaded engagement thereof with an externally threaded stud on a conventional bushing well receptacle when the bushing 96 is suitably rotated thereon as will be more fully explained below. As mentioned above, in order to facilitate free rotation of bushing 96 within recess 34, pin member 88 is loosely seated in recess 86 and its projecting end freely rides upon the upwardly facing surface 94 during such relative movement. In this regard, the axial dimension of recess 86 and the length of pin member 88 are chosen to afford a sufficient tolerance permitting slight up and down movement of the pin member when the bushing rotates. In order to further facilitate such rotational movement, annular recess 100 is located a sufficient axial distance from recess end wall 84 to provide the aforementioned sufficient tolerance or clearance between the top surface 118 of segment 110 and end wall 84. Thus, pin member 88 may be inserted into its recess 86, followed by insertion of bushing 96 into recess 34 whereupon C-spring retainer ring 98 may be seated in recess 100 thus providing means for maintaining the pin 88 and the bushing 96 in the position shown all of the while permitting free rotation of the bushing relative to the pin within recess 34 in opposite directions through the aforementioned free rotation angle less than 360°.

Disposed within the external surface of bushing 96 is a circumferentially extending contact-receiving recess 120 of a suitable size for receivably seating therein a well-known annular shaped, resilient "louvered" contact element 122 of a type normally used in the art to transfer large magnitude electrical current between sliding or rotating interfacing parts. In the instant invention, annular contact element 122 permits a sliding type of mechanical and electrically conductive engagement to be effected between bushing 96 and the internal wall surface of recess 34 of conductor bar 32 which, in turn, enables insert 10 to be freely rotatable circumferentially about bushing 96 without interruption of the electrical circuit between sleeves 40, 42 and the bushing 96 as will be more fully explained hereinafter. The structural details of a resilient louvered electrical contact element 122 which may be used in the present invention are fully described in U.S. Pat. No. 4,050,149, which patent is incorporated herein by this reference and made part of the present disclosure.

It will now be appreciated that due to the aforementioned clearance between bushing 96 and pin 88, wall 84, the inner surface of recess 34 and retainer ring 98, bushing assembly 96 is free to rotate within recess 34 all of the while maintaining an electrically conductive and mechanical slide fit engagement with the inner wall surface of recess 34 via contact element 122. This enables insert 10 to be freely rotatable circumferentially to and fro in reversible opposite first and second directions through an angle of about 180° or about up to one-half full turn, subsequent to manually torquing insert 10 into fixed operative engagement with a bushing well stud without need to loosen or unscrew insert 10 at threaded bushing well stud 82 as will now be more fully described.

Assume that double bushing insert 10 is to be assembled onto a transformer by manually threading insert 10 onto the stud of transformer bushing well 12. Insert 10 is rotated in a clockwise direction to advance bushing 96 onto threaded-stud 82 via threaded hole 116. During the beginning of the applied tightening or torquing action, insert 10 freely revolves circumferentially about axis 20 and bushing 96 in the clockwise direction through an angle of up to about 180° due to bushing assembly 96 being free to rotate within recess 34. This enables pin member 88 carried within pin receiving aperture 86, to be freely revolved circumferentially about axis 20 in the same clockwise direction as torqued insert 10 until pin member 88 strikes or abuts vertical wall surface 112 of segmental portion 110. The abutting engagement between pin member 88 and wall 112 causes any further clockwise movement of insert 10 to be transmitted via pin member 88 to segment 110 and bushing 96 thus causing these parts to rotate together. Such further rotation causes the internally threaded hole in bushing 96 to matingly engage the complementary threaded stud of the bushing well until surface 108 bottoms on a confronting surface of the bushing well receptacle.

This completes the act of mechanically and electrically uniting insert 10 with bushing well 12, whereupon insert 10 is enabled by means 80 to be adjustably freely rotated counterclockwise as viewed in FIG. 5 through an angle of up to about 180° in reversible or opposite directions without unscrewing or backing-off bushing 96 from threaded-stud 82 (FIG. 1) whereby insert 10 may be oriented in a desired angular position to facilitate engagement of male connector members with either leg portion 24 or 26. That is, the angular position of insert 10 may be adjusted by manually freely rotating the insert about bushing 96 (and axis 20) in a counterclockwise direction through an angular distance of up to about 180° or until pin member 88 is moved into abutting engagement with vertical wall 112 which abutting engagement prevents further free movement in the counterclockwise direction, unless it is desired to remove insert 10 from bushing well 12. If this is desired, a continuing counterclockwise torquing force may be applied to insert 10 until the latter threadably backs-off from bushing well stud 82. If it is not desired to remove insert 10 and if further movement in the counterclockwise direction is prevented, means 80 enables insert 10 to be readjusted by merely freely rotating insert 10 in a clockwise direction through an angular distance of up to about 180° or until engagement between pin member 88 and wall 112 again comes about. Of course, it will be appreciated that the insert may be located or stopped at any angular position between the extreme limits of the clockwise and counterclockwise movements described above which limits are defined by the opposed lateral portions of wall surface 112 abuttingly engaging pin member 88.

Thus, referring again to FIG. 1, upon adjustably rotating bushing insert 10 through a desired angular rotation or to a desired angular position, it may in accordance with another feature of the invention be positively fixed thereat with a hold-down bail assembly generally indicated by reference numeral 132. In its preferred form bail assembly 132 generally comprises a dumb-bell shaped plate 134 preferably fabricated of metal such as stainless steel, which is adapted to cooperatively engage a ring-shaped plate 116 circumferentially affixed to the cylindrically-shaped body portion 138 of bushing well 12. A pair of rods 140 is provided including wing nuts 142 therewith for securely anchoring the two plates 134 and 136 to each other when the insert 10 is properly seated in bushing well 12. Plate 134 comprises a generally elongated shape having opposed planar-shaped side surfaces 144 (only the upper surface being shown in FIG. 1), a pair of transversely spaced, arcuately shaped concave side edges 146, and a pair of longitudinally spaced, opposed arcuately shaped, convex end edges 148. Each arcuately shaped concave side edge 146 is complementary to the circular shape or contour of the outer surfaces of insert legs 24 and 26, respectively, so as to enable each outer surface portion of each leg 24, 26 to seat snugly within a corresponding arcuately shaped concave side edge portion 146 of plate 134 when plate 134 is positioned between legs 24 and 26 as will be more fully explained hereinafter. A rim portion adjacent each arcuately shaped, convex end edge 148 is provided with a plurality of through apertures 150, spaced from each other so as to extend along respective arcs between the opposed arcuately shaped concave side edges 146 as substantially depicted in FIG. 1. In the preferred embodiment, the apertures 150 are spaced approximately 15° from each other along their respective arcs.

Each rod 140 has an elongated shape and comprises a threaded end portion 152 for threadably receiving thereon a corresponding wing nut 142 and has an unthreaded hook-shaped opposed end portion 155 for attaching to ring-shaped plate 136 as will be more fully described hereinbelow.

Ring-shaped plate 136 is integrally fixed to bushing-well body 138 as is well-known in the art and includes planar, opposed upper and lower surfaces 154, 156. Plate 136 is provided with at least four upright members or tabs 162 equally circumferentially spaced about upper surface 154. Each tab 162 projects vertically from surface 154 and is provided with a through aperture 164 therein, such that, the hook-shaped end 155 of a corresponding one of rods 140 is enabled to be inserted therein thus anchoring each rod to plate 136 and therefore to bushing-well 12.

In practice, insert 10 is mated with the stud 82 of the bushing well and rotated to a desired angular position in the manner described above. Next, plate 134 is positioned between bushing legs 24, 26, such that, side surface 146 and the central or necked-down portion of plate 134 rests firmly on planar-shaped surface 18 of insert 10, and a contoured region of each conically shaped leg 24 and 25, respectively, is seated snugly within a corresponding contoured region defined by the two arcuately shaped, concave side edges of plate 134. The rods 140 are engaged with a pair of opposed tabs 162 via their hooked ends 154, and then the threaded ends 152 of rods 140 are inserted within a corresponding pair of opposed apertures 150 associated with opposed edges 148 respectively, with the selected apertures being aligned with the two tabs. Bail assembly 132 is then mechanically locked into position by finally threadably attaching each wing nut 142 onto a corresponding rod end 152. Bail assembly 132 thus substantially prevents insert 10 from being rotatably displaced from its desired angular position when subjected to mechanical and environmental load conditions in which inserts of this type typically function. Not only does bail assembly 132 substantially prevent rotatable movement of insert 10 after it is secured into a desired angular position therewith but, furthermore due to the series of spaced apertures 150 associated with each convex end 148, the plate 134 may be secured relative to plate 136 and tabs 162 in many different selected angular positions via rods 140 and wing nuts 142. Thus, the apertures 150 enable rods 140 to connect the two plates 134, 136 to one another, such that, legs 24 and 26 always seat snugly within corresponding ones of the two arcuately shaped concave side edges 146 regardless of the angular position into which insert 10 is rotatably adjusted.

The term "bushing" as applied to element 96 is to be distinguished from the terms "double bushing" or "double bushing insert" as applied to the entire assembly indicated generally by reference numeral 10.

Although the foregoing preferred embodiment of the invention has been disclosed in detail to fulfill the requirements of statute, it is anticipated that many variations and modifications may be made without departing from the spirit and scope of the invention as defined only by the appended claims.

I claim:

1. A double bushing insert adapted to be threadedly engageable with a bushing well receptacle wherein the double bushing insert comprises a first leg portion including means for threadedly engaging the complementary threaded stud of the bushing well receptacle, and second and third leg portions including female connector means for separable engagement with a corresponding male electrical connector means, wherein the improvement comprises:

means for rotatably supporting said threadedly engaging means within said first leg portion; and means for causing simultaneous rotation of said first leg portion and said threadedly engaging means in a first direction and for permitting limited relative rotation between said first leg portion and said threadedly engaging means in a second direction.

2. The invention of claim 1 wherein said first leg portion includes conductive means electrically connected to the female connector means in each of said second and third leg portions and wherein said first leg portion includes means for maintaining an electrical connection between said conductive means and said threadedly engaging means.

3. The invention of claim 1 wherein said last-mentioned means includes means for limiting said relative rotation in a second direction throughout a predetermined rotation angle of less than 360°.

4. The invention of claim 1 wherein said last-mentioned means includes means for limiting said relative rotation in a second direction throughout a predetermined rotation angle of about 180°.

5. The invention of claim 1 wherein said threadedly engaging means comprises a rotatable bushing having an internally threaded aperture disposed in one end thereof and said supporting means comprises a recess in said first leg portion and means for maintaining said rotatable bushing in said recess.

6. The invention of claim 5 wherein said recess is disposed in a conductive bar supported within said first leg portion and conductive means are provided for maintaining an electrical connection between said conductive bar and said rotatable bushing.

7. The invention of claim 6 wherein said conductive means comprises a resilient annular contact member supported between said rotatable bushing and the wall surface of said recess.

8. The invention of claim 3 wherein said means for causing simultaneous rotation in a first direction and relative rotation in a second direction comprises a drive member carried by said first leg portion and means carried by said threadedly engaging means for being cooperatively engaged by said drive member when said drive member is rotated in either said first or said second direction.

9. The invention of claim 8 wherein said threadedly engaging means comprises a bushing supported for rotation in either said first or second direction in a recess in said first leg portion, said bushing including an internally threaded aperture disposed in one end thereof for mating engagement with a complementary externally threaded stud on said bushing well, wherein said drive member comprises a pin carried by said first leg portion, and wherein said rotatable bushing is adapted to be abuttingly engaged by said pin when said first leg portion rotates in either said first or second direction throughout a predetermined rotation angle.

10. The invention of claim 9 wherein said recess has an open end and a wall surface defining a closed end, said pin being mounted in another recess in said wall surface whereupon said pin has a projecting end engaging a confronting end surface on said bushing, the axis of said pin being radially spaced relative to the axis of said first mentioned recess, and wherein said bushing includes a portion projecting from said confronting end surface of said bushing toward said wall surface to define a laterally extending surface on said bushing radially spaced from said first recess axis for abuttingly engaging said pin when said first leg portion rotates relative to said bushing whereby opposed end portions on said laterally extending surface define said predetermined rotation angle.

11. The invention of claim 1 further including means for maintaining the position of said insert fixed in a predetermined angular position after rotation in said second direction after said first leg portion has been matingly engaged with said bushing well by rotating said first leg portion in said first direction.

12. The invention of claim 11 wherein said means for maintaining said position comprises a generally flattened elongated plate and a fastener means, said fastener means being adapted to be releasably connected between said plate and said bushing well receptacle, said plate being adapted to seat between said second leg portion and said third leg portion of said insert so as to prevent said rotation when said fastener means is releasably connected therebetween, said plate including means for enabling said fastener means to be connected regardless of said angular position at which the insert is fixed after causing said rotation.

13. The invention of claim 12 wherein said means at said plate for enabling said fastener means to be connected comprises two pluralities of transversely spaced apertures longitudinally spaced from one another.

14. The invention of claim 13 wherein said plate further comprises a pair of opposed side edges, each side edge having a contoured shape complementary to a contoured shape of a corresponding outer surface of one of said second leg portion or said third leg portion such that said plate is enabled to seat substantially snugly therebetween.

15. The invention of claim 14, wherein said fastener means comprises a pair of elongated rods, each rod having one end adapted to lockingly engage a desired aperture within a corresponding one of said two pluralities of spaced apertures and having an opposite end adapted for lockingly engaging said bushing well receptacle.

* * * * *